US005358293A

United States Patent [19]

Bradley, Jr. et al.

[11] Patent Number: 5,358,293

[45] Date of Patent: Oct. 25, 1994

[54] REMOVABLE REFRIGERATOR DOOR RESTRAINT DEVICE

[75] Inventors: James B. Bradley, Jr., 4805 Inverness Dr., Tyler, Tex. 75703; Richard W. Beasley, Lindale, Tex.

[73] Assignee: James B. Bradley, Jr., Tyler, Tex.

[21] Appl. No.: 110,980

[22] Filed: Aug. 24, 1993

[51] Int. Cl.[5] ..... E05C 19/18

[52] U.S. Cl. ..... 292/288; 292/DIG. 65; 292/DIG. 71; 292/269

[58] Field of Search ..... 292/DIG. 65, DIG. 71, 292/151, 269, 273, 288, 189, 302; 24/615, 616

[56] References Cited

U.S. PATENT DOCUMENTS

| | | | |
|---|---|---|---|
| 833,458 | 10/1906 | Hausherr | 24/615 |
| 2,924,476 | 6/1958 | Deane | 292/209 |
| 3,015,869 | 1/1962 | Rapata | 292/DIG. 38 |
| 3,621,684 | 11/1971 | Horvay et al. | 292/DIG. 71 |
| 4,497,093 | 2/1985 | Haberkorn | 24/615 |
| 4,715,629 | 12/1987 | Robinson | 292/256 |
| 4,782,564 | 11/1988 | Sloan | 24/616 |
| 5,114,193 | 5/1992 | Nass | 292/DIG. 71 |
| 5,114,194 | 5/1992 | Toifl et al. | 292/106 |
| 5,152,564 | 10/1992 | Martineau | 292/288 |
| 5,203,597 | 4/1993 | Wheelock | 292/258 |
| 5,209,533 | 5/1993 | Menard | 292/288 |
| 5,265,921 | 11/1993 | Nikitas et al. | 292/DIG. 71 |

FOREIGN PATENT DOCUMENTS

| | | | |
|---|---|---|---|
| 2160255 | 12/1985 | United Kingdom | 292/DIG. 38 |
| 2172049 | 9/1986 | United Kingdom | 292/288 |

*Primary Examiner*—Peter M. Cuomo
*Assistant Examiner*—Darnell M. Boucher
*Attorney, Agent, or Firm*—Ross, Howison, Clapp & Korn

[57] ABSTRACT

A restraint device for preventing access to a compartment having a door includes a plate. The plate includes first and second ends, the second end thereof including an aperture. Structure is provided for mounting the plate to the compartment. A closure device is provided, and is slidably disposed within the plate aperture for selectively blocking the opening of the compartment door. The closure device is disposed generally perpendicular to the plate and is adapted to be positioned adjacent to the compartment door and is operable between first and second positions. In the first position, the closure device rigidly engages the plate and is positioned adjacent to the compartment door to thereby prevent opening of the compartment door. In the second position, the closure device is disengaged from the plate and is slidable to a position to allow opening of the compartment door.

5 Claims, 7 Drawing Sheets

REMOVABLE REFRIGERATOR DOOR RESTRAINT DEVICE

TECHNICAL FIELD OF THE INVENTION

The present invention relates to restraint devices, and more particularly to a device which blocks door opening by young children to appliances, such as, for example, refrigerators, freezers, dishwashers, ovens, and the like.

BACKGROUND OF THE INVENTION

Very young children tend to open refrigerator doors often during the day, thus creating problems for parents. As examples, while reaching into the refrigerator, children can drop and break bottles, knock dishes of food out onto the floor, gain access to refrigerated medicines that might harm them, see and try to eat food that is not good for them, and leave the refrigerator door open causing excessive energy loss. The present invention provides a practical solution to a bothersome and serious problem faced by parents of young children.

SUMMARY OF THE INVENTION

In accordance with the present invention, a restraint device for preventing access to a compartment having a door is provided. The restraint device temporarily blocks the opening of the door and includes a plate. The plate includes first and second ends, the second end thereof including an aperture. Structure is provided for mounting the plate to the compartment. A closure device is provided, and is slidably disposed within the plate aperture for selectively blocking the opening of the compartment door. The closure device is disposed generally perpendicular to the plate and is adapted to be positioned adjacent to the compartment door and is operable between first and second positions. In the first position, the closure device rigidly engages the plate and is positioned adjacent to the compartment door to thereby block opening of the compartment door. In the second position, the closure device is disengaged from the plate and is slidable to a position to allow opening of the compartment door.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
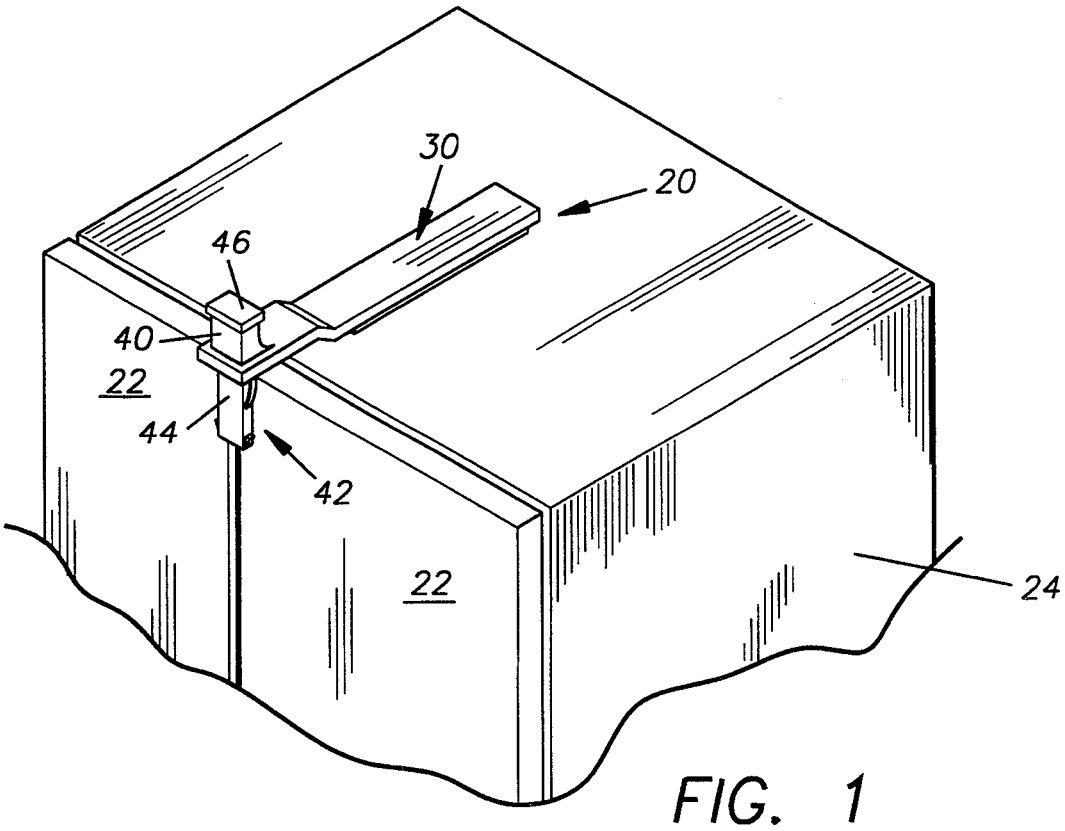
FIG. 1 is a perspective view of the present restraint device for use with a refrigerator.

Referring to FIG. 1, the present restraint device is illustrated, and is generally identified by the numeral 20. Restraint device 20 is illustrated in FIG. 1 for use in blocking the opening of a door 22 of a refrigerator 24, it being understood that refrigerator 24 is shown for illustrative purposes only, the present restraint device 20 being usable with any type of compartment having a door such as, for example, freezers, dishwashers, conventional ovens, microwave ovens, and the like. Restraint device 20 may be positioned at the top of refrigerator door 22 or at the side of refrigerator door 22 for blocking opening of refrigerator door 22 when restraint device 20 is in the engaged and locked position.

Referring simultaneously to FIGS. 1–8, restraint device 20 includes a plate, generally identified by the numeral 30. Plate 30 includes ends 30*a* and 30*b*, a top surface 30*c*, a bottom surface 30*d*, and a bend 30*e*. Bend 30*e* is used to accommodate refrigerators 24 having a door 22 which extends above the top of refrigerator 24 or which extends outwardly of a side wall of refrigerator 24.

Disposed on surface 30*d* of plate 30 is a progressive release mechanism such as, for example, a magnet 34. Magnet 34 is utilized for mounting restraint device 20 to refrigerator 24. Additionally, Velcro material may be utilized for mounting restraint device 26 to refrigerator 24.

Figure 2:
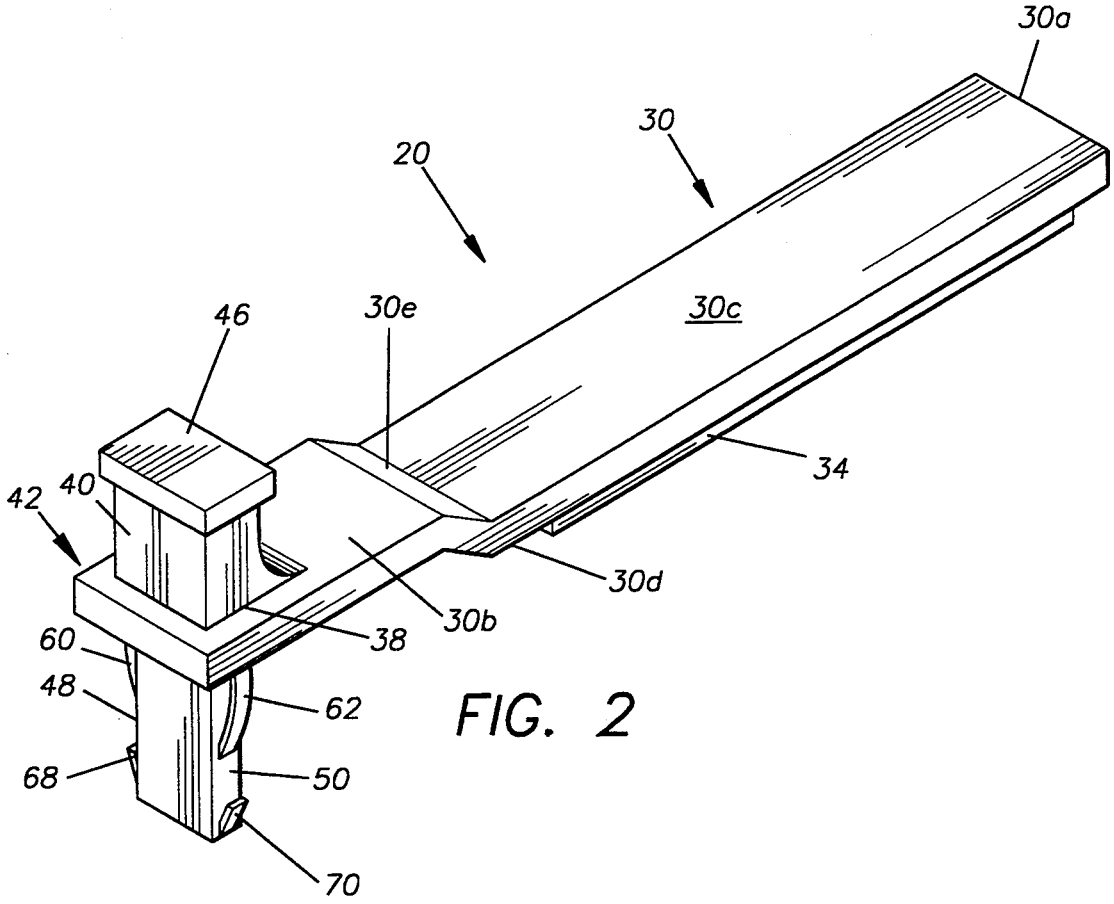
FIG. 2 is a perspective view of the present restraint device in the engaged and locked position for blocking opening of a door.
Figure 3:
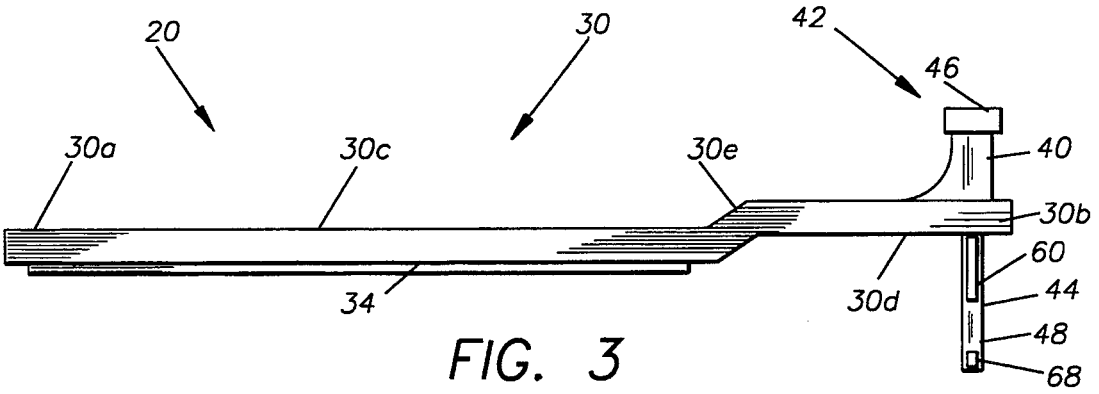
FIG. 3 is a side elevational view of the present restraint device corresponding to the position illustrated in FIG. 2.
Figure 4:
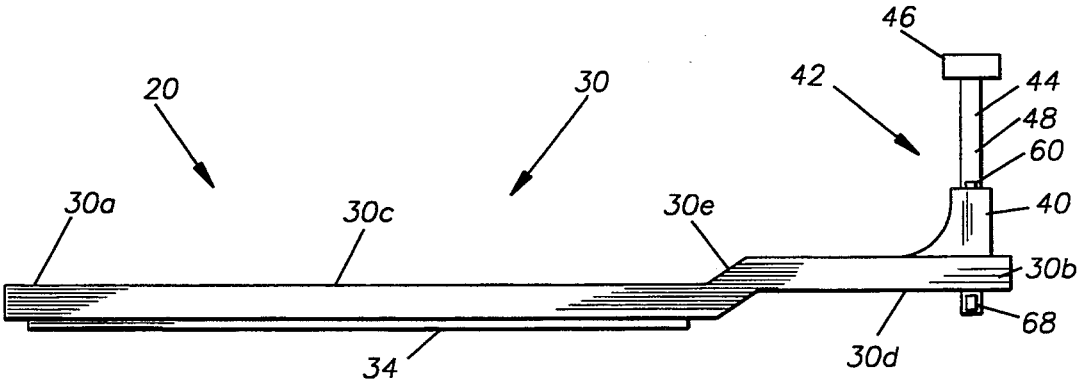
FIG. 4 is a side elevational view of the present restraint device illustrated in the disengaged and unlocked position to allow opening of a door.
Figure 5:
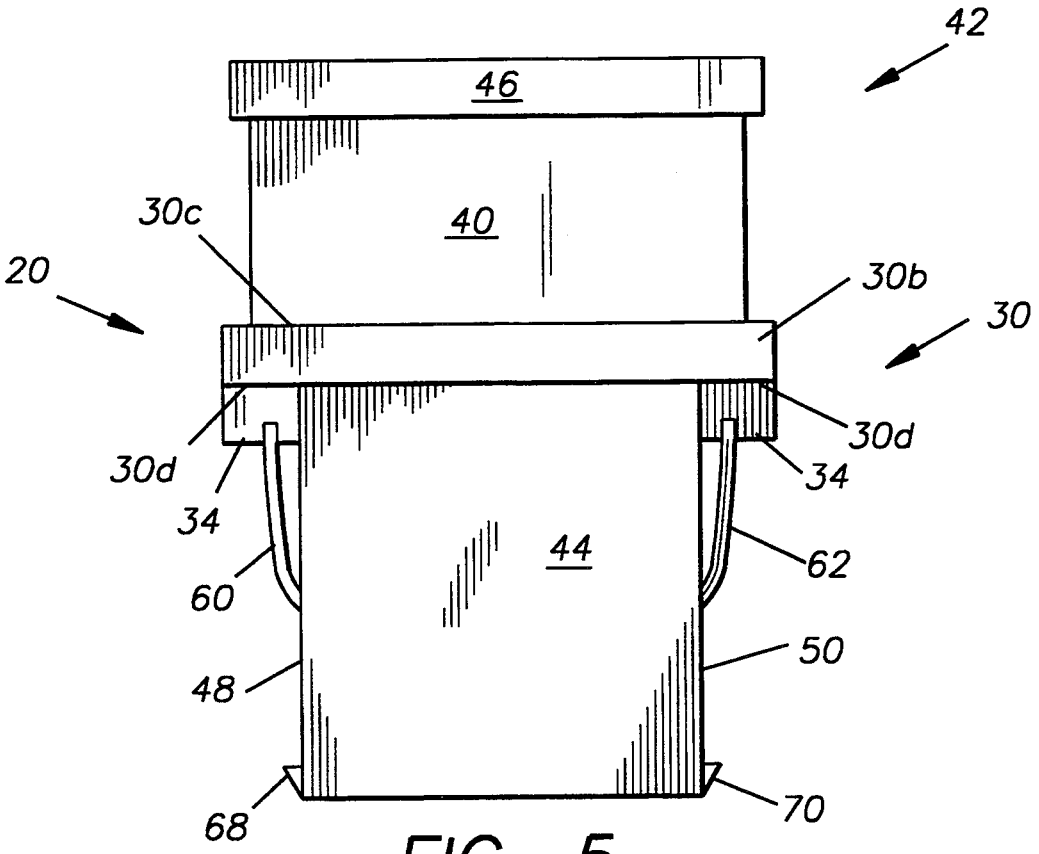
FIG. 5 is front elevational view of the present restraint device in the engaged and locked position as illustrated in FIG. 2.
Figure 6:
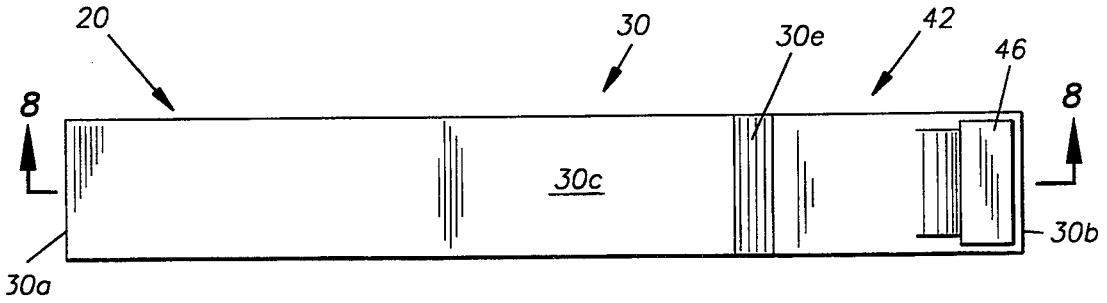
FIG. 6 is a top plan view of the present restraint device.
Figure 7:
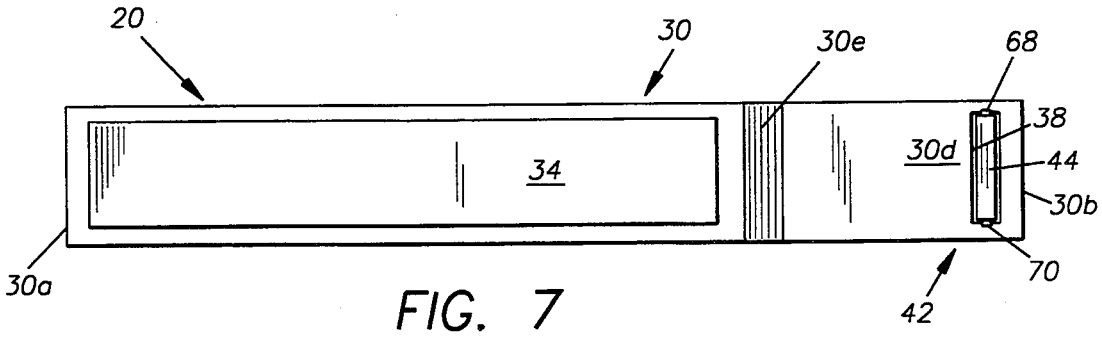
FIG. 7 is a bottom plan view of the present restraint device.
Figure 8:
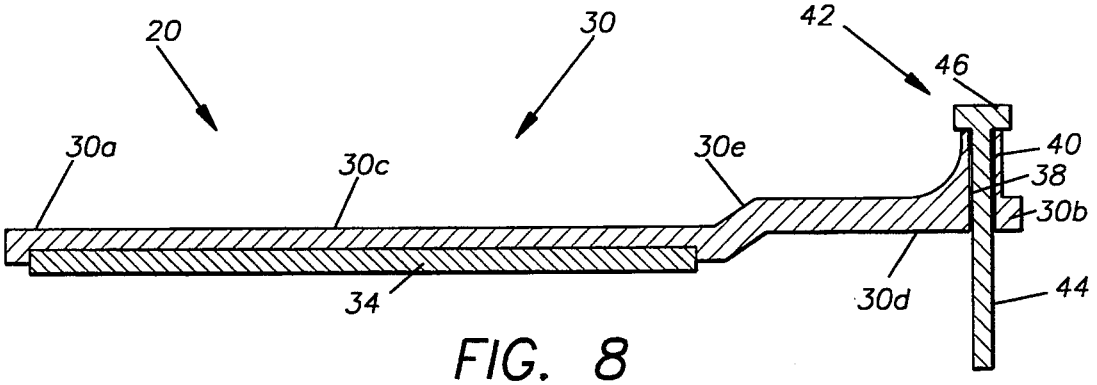
FIG. 8 is a sectional view taken generally along sectional lines 8—8 of FIG. 6.

End 30*b* of plate 30 includes an aperture 38, more clearly shown in FIGS. 7 and 8 and a housing 40. Disposed within aperture 38 is a closure device, generally identified by the numeral 42. Closure device 42 includes a pin or bar 44 having a top 46 and side walls 48 and 50. Bar 44 is slidable within aperture 38 between an engaged and locked position as shown in FIGS. 2 and 3 and a disengaged and unlocked position as shown in FIG. 4. In the engaged and locked position of closure device 42, the opening of refrigerator door 22 is blocked. In the disengaged and unlocked position of closure device 42, refrigerator door 22 can be opened.

Referring simultaneously to FIGS. 2–5, bar 44 includes resilient tines or tabs 60 and 62 disposed on side walls 48 and 50, respectively, of bar 44. Tabs 60 and 62 are interconnected to bar 44 and are resiliently deflectable to selectively pass through aperture 38 as bar 44 moves within aperture 38. As more clearly shown in FIG. 5, tabs 60 and 62 are normally biased spaced apart from side walls 48 and 50. When bar 44 is in the engaged and locked position, tabs 60 and 62 will engage bottom surface 30*d* of plate 30 to prevent the withdrawal of bar 44 from aperture 38, thereby allowing bar 44 to be disposed adjacent to door 22 of refrigerator 24 and block the opening of door 22. In order to open refrigerator door 22, tabs 60 and 62 are pressed against side walls 48 and 50 of bar 44, and bar 44 is grasped at top 46 and pulled through aperture 38, such that tabs 60 and 62 are allowed to slide through aperture 38 thereby withdrawing bar 44 from its position adjacent to refrigerator door 22 to allow refrigerator 22 to open. FIG. 4 illustrates tabs 60 and 62 being positioned adjacent to side walls 48 and 50 of bar 44 through aperture 38. In order to reengage and lock bar 44, bar 44 is pushed through aperture 38 such that tabs 60 and 62 spring outwardly to reengage bottom surface 30*d* of plate 30.

Disposed on side walls 48 and 50 of bar 44 are tabs 68 and 70, respectively. Tabs 68 and 70 are normally biased spaced apart from side walls 48 and 50 and function to prevent the complete removal of bar 44 from aperture 38 in the disengaged and unlocked position of closure device 42.

Figure 9:
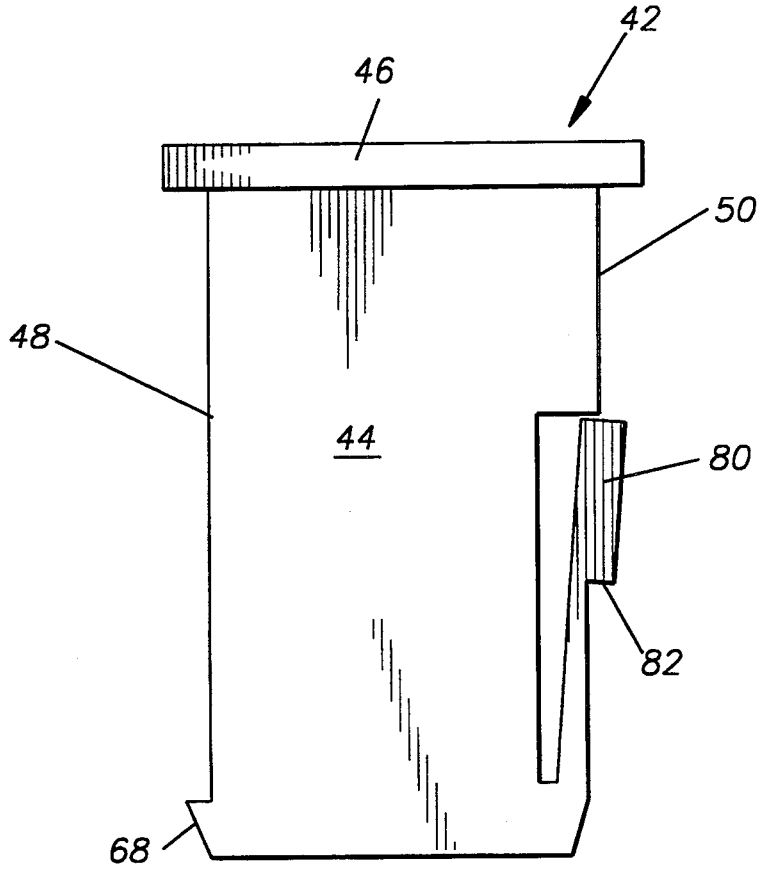
FIG. 9 is a front elevational view of an additional embodiment of the closure device of the present invention.

Referring to FIG. 9, wherein like numerals are utilized for like and corresponding components previously identified, a further embodiment of bar 44 is illustrated. Bar 44 includes a resilient tab 80 which is integrally formed in side wall 50 of bar 44. Tab 80 is normally biased spaced apart from side wall 50. When bar 44 is in the engaged and locked position, tab 80 will engage bottom surface 30*d* of plate 30 to prevent the withdrawal of bar 44 from aperture 38. In order to open refrigerator door 22, tab 80 is pressed against side wall 50 of bar 44, such that bar 44 may be pulled through aperture 38. Tab 80 includes a step 82 which engages the top surface 30*c* of plate 30 when bar 44 is in the disengaged and unlocked position of closure device 42.

Figure 10:
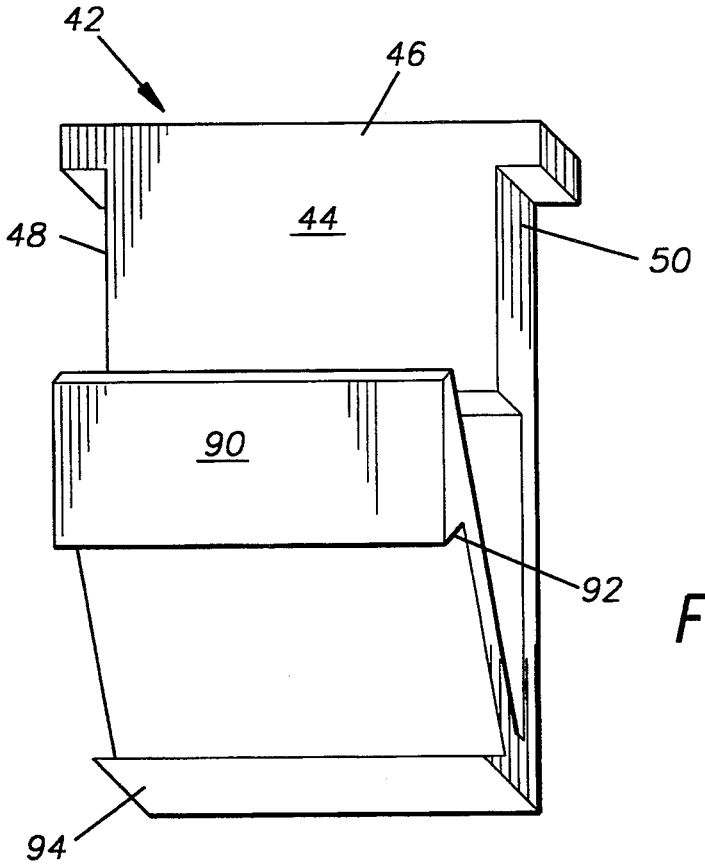
FIG. 10 is a perspective view of a further embodiment of the closure device of the present invention.

Referring now to FIG. 10, wherein like numerals are utilized for like and corresponding components previously identified, a further embodiment of bar 44 is illustrated. Bar 44 includes a tab 90 disposed between side walls 48 and 50 of bar 44. Tab 90 functions in a manner similar to tab 80, and is normally biased spaced apart from bar 44. When bar 44 is in the engaged and locked position, tab 90 will engage bottom surface 30*d* of plate 30 to prevent the withdrawal of bar 44 from aperture 38. In order to open refrigerator door 22, tab 90 is pressed against bar 44, such that tab 90 is allowed to slide through aperture 38 thereby withdrawing bar 44 from its position adjacent to refrigerator door 22 to allow refrigerator door 22 to open. Tab 90 includes a step 92 which engages top surface 30*c* of plate 30 when bar 44 is in the disengaged and unlocked position of closure device 42.

Plate 30 and closure device 42 may be fabricated from plastic materials. Additionally, tabs 60, 62, 68, 70, 80, and 90 can be fabricated from plastic materials which embody an inherent resiliency for repeated operations of closure device 42 and are integrally formed with closure device 42.

It therefore can be seen that the present restraint device provides for a device that is easily attachable to a compartment where it is desired to prevent the opening of a door to the compartment. Activation of the present restraint device requires a positive action, and thereby an inadvertent activation of the present device will not occur to unknowingly block the opening of a door to a compartment. The present device is simple in operation, easy to install without damage to the compartment, and is not readily disengageable by a young child.

Whereas the present invention has been described with respect to specific embodiments thereof, it will be understood that various changes and modifications will be suggested to one skilled in the art and it is intended to encompass such changes and modifications as fall within the scope of the appended claims.

We claim:

1. A restraint device for preventing access to a compartment having a door by blocking the opening of the door, the device comprising:

a plate having first and second ends and top and bottom surfaces, said second end thereof including an aperture;

means for releasably mounting said plate to the compartment;

closure means slidably disposed within said plate aperture for selectively blocking opening of the compartment door, said closure means disposed generally perpendicularly to said plate and adapted to be positioned adjacent to the compartment door, and being operable between first and second positions, such that in said first position, said closure means rigidly engages said plate and is positioned adjacent to the compartment door to thereby block opening of the compartment door, and in said second position, said closure means is disengaged from said plate and retained within said plate aperture and slidable to a position to allow opening of the compartment door; and said closure means including:

a bar extending above and below said plate within said plate aperture;

a resilient tab attached to said bar and movable between a retracted position adjacent said bar and disposed adjacent said top surface of said plate, in said closure means second position, and an extended position, spaced apart from said bar, in said closure means first position to engage said bottom surface of said plate thereby preventing slidable movement of said bar in said plate aperture; and means attached to said bar for preventing removal of said bar from said plate aperture.

2. The restraint device of claim 1 wherein said bar includes first and second side walls and said resilient tab is attached to one of said side walls.

3. The restraint device of claim 1 wherein said bar includes first and second side walls and said resilient tab includes first and second resilient tabs attached to said first and said second side walls, respectively.

4. The restraint device of claim 1 wherein said resilient tab includes a step for engaging said plate top surface in said closure means second position.

5. The restraint device of claim 1 wherein said means for mounting said plate to the compartment includes a magnet.

* * * * *